US009888721B2

(12) United States Patent
Chan

(10) Patent No.: US 9,888,721 B2
(45) Date of Patent: Feb. 13, 2018

(54) E-CIGARETTE WITH SEGREGATED CARTRIDGE FOR SELECTIVE DISBURSEMENT OF LIQUID SOLUTION FLAVORS

(71) Applicant: Erik Chan, Orange, CA (US)

(72) Inventor: Erik Chan, Orange, CA (US)

( * ) Notice: Subject to any disclaimer, the term of this patent is extended or adjusted under 35 U.S.C. 154(b) by 257 days.

(21) Appl. No.: 14/873,191

(22) Filed: Oct. 1, 2015

(65) Prior Publication Data

US 2016/0095356 A1 Apr. 7, 2016

Related U.S. Application Data

(60) Provisional application No. 62/058,531, filed on Oct. 1, 2014.

(51) Int. Cl.
*A24F 47/00* (2006.01)
*H05B 3/44* (2006.01)
*F22B 1/28* (2006.01)

(52) U.S. Cl.
CPC ..... *A24F 47/008* (2013.01); *H05B 3/44* (2013.01); *F22B 1/284* (2013.01)

(58) Field of Classification Search
CPC .... A24F 1/30; A24F 1/14; A24F 47/00; A24F 47/002; A24F 47/008; A24F 47/004
USPC ..... 131/171–260, 270–273, 328–368
See application file for complete search history.

(56) References Cited

U.S. PATENT DOCUMENTS 2,819,814 A * 1/1958 Hatch ..... A24F 15/005 221/121
6,651,809 B2 * 11/2003 Holler ..... A24F 15/20 131/274
8,707,965 B2 * 4/2014 Newton ..... A61M 15/06 128/202.21
8,757,169 B2 * 6/2014 Gysland ..... A24F 47/008 131/270
2008/0247892 A1 * 10/2008 Kawasumi ..... F04B 43/12 417/476
2014/0060527 A1 * 3/2014 Liu ..... A61M 15/06 128/202.21
2014/0190503 A1 * 7/2014 Li ..... A61M 15/06 131/329

(Continued)

*Primary Examiner* — Phuong Dinh
(74) *Attorney, Agent, or Firm* — Elizabeth Yang

(57) ABSTRACT

An e-cigarette provides enables selective disbursement of multiple liquid solutions having different flavors into an atomizing chamber for vaporization with a single atomizer. A cartridge containing the liquid solutions segregates the various flavored liquid solutions into multiple compartments through a rotatable barrier. Each compartment is in communication with a cartridge opening and a chamber opening. A rotatable plate attaches to the rotatable barrier. The rotatable plate includes a plate opening and a plate plug. The plate plug intervenes between the cartridge opening and the chamber opening of a first compartment to restrict passage of a liquid solution from the first compartment. Simultaneously, the plate opening enables passage of a different liquid solution through the cartridge opening and the chamber opening from a second compartment. Thus, the rotatable plate regulates passage of the desired liquid solution from a compartment to an atomizer for vaporizing the desired flavor of liquid solution.

20 Claims, 1 Drawing Sheet

(56) References Cited

U.S. PATENT DOCUMENTS

| | | | | |
|---|---|---|---|---|
| 2014/0261494 | A1* | 9/2014 | Scatterday | A24F 47/008 131/329 |
| 2014/0261500 | A1* | 9/2014 | Park | A24F 47/008 131/329 |

* cited by examiner

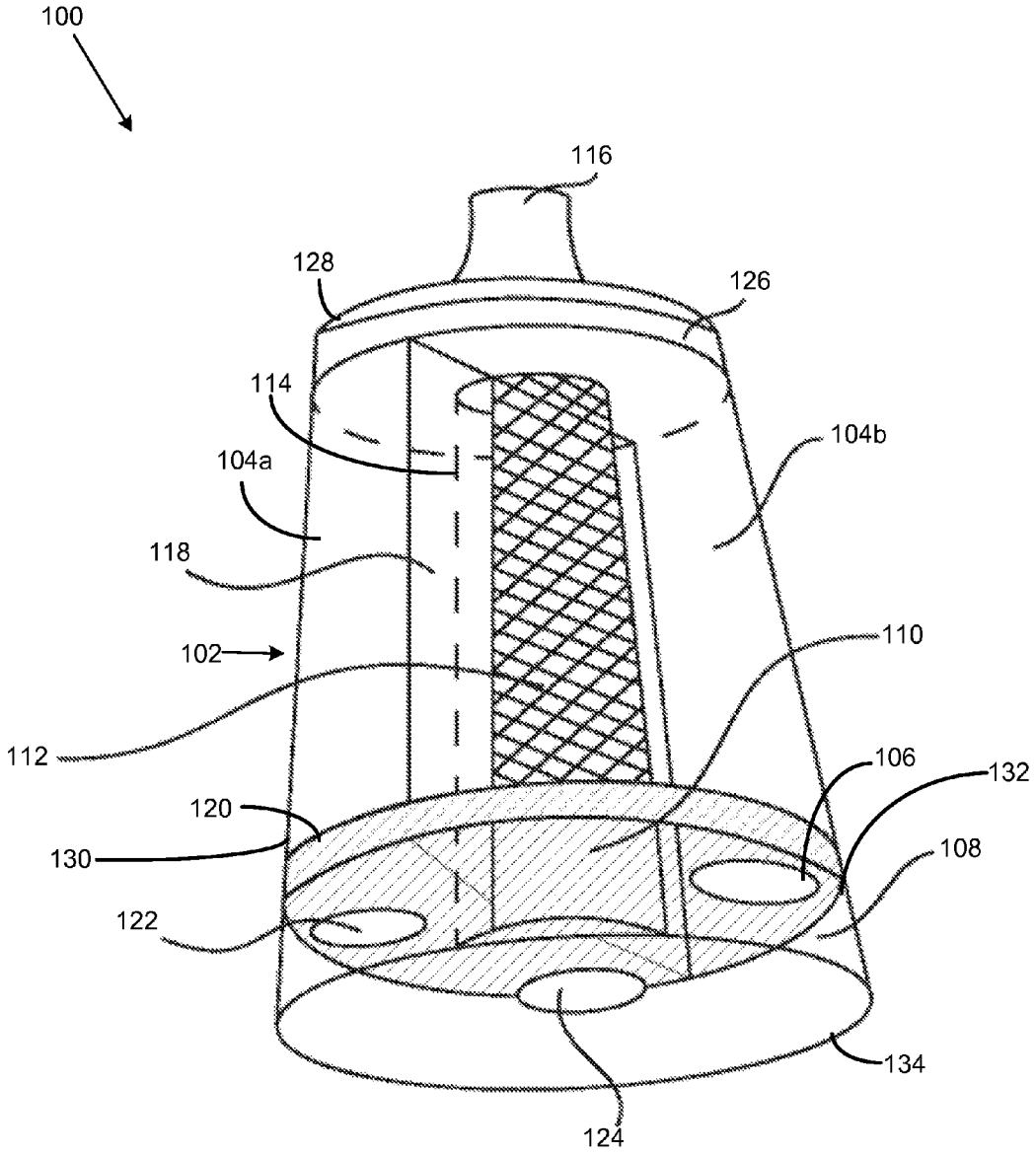
100
116
128
126
114
104b
104a
118
102
110
112
106
132
120
130
108
122
134
124

E-CIGARETTE WITH SEGREGATED CARTRIDGE FOR SELECTIVE DISBURSEMENT OF LIQUID SOLUTION FLAVORS

FIELD OF THE INVENTION

The present invention relates generally to an e-cigarette with segregated cartridge for selective disbursement of different flavored liquid solutions. More so, an e-cigarette provides a single atomizer operational in an atomizing chamber having a plurality of chamber openings, and a cartridge having a plurality of cartridge openings; whereby the cartridge contains a plurality of liquid solutions segregated into compartments with a rotatable barrier; whereby the plurality of liquid solutions are selectively dispensed into the atomizing chamber by rotating a rotatable plate having a plate plug and a plate opening; whereby the plate plug restricts passage of a first flavor of liquid solution from a first compartment to the atomizer; whereby the plate opening enables passage of a second flavor of liquid solution from a second compartment to the atomizing chamber for vaporization, so as to enable simulated smoking with a desired flavor through the e-cigarette.

BACKGROUND OF THE INVENTION

It is known that e-cigarettes emulate tobacco cigarette smoking by producing smoke replacement that may be similar in its physical sensation, general appearance, and sometimes flavor, i.e., with tobacco fragrance, menthol taste, added nicotine etc. In an effort to accommodate the prohibition against smoking indoors in public areas, electronic cigarettes have been provided. Electronic cigarettes allow a smoker to mimic the ritual of smoking while indoors in a public area.

The electronic cigarette is typically a plastic stick that uses a nicotine filter cartridge to simulate the traditional smoking experience. Unlike the traditional smoking experience, however, there is no smoke or tar. Nearly all electronic cigarettes have the shape of a regular cigarette and provide the user with either a mixture of tobacco aromas, tobacco substitutes, or nicotine/nicotine substitutes as replacements for an all tobacco cigarette.

Typically, the e-cigarette is battery-powered. The e-cigarette may be automatically activated by taking a puff. Though some e-cigarettes may be actuated by pressing a button manually. E-cigarettes are generally cylindrical, so as to simulate a real cigarette. A battery portion of the e-cigarette includes a controller and rechargeable battery for providing electrical power. Sometimes, a cartomizer generates an aerosol mist that is a replacement for cigarette smoke.

In many instances, the e-liquid solution has a flavor. The e-liquid solution for producing vapor in electronic cigarettes, may also be known as e-juice or e-liquid, and comprised from a solution of Propylene Glycol (PG) and/or Vegetable Glycerin (VG) and/or polyethylene glycol 400 (PEG400) mixed with concentrated flavors, and optionally, a variable percent of a liquid nicotine concentrate. These e-liquid solutions are often sold in a bottle or as pre-filled disposable cartridges. Myriad flavors which resemble the taste of regular tobacco, menthol cigarette menthol, vanilla, coffee, cola and various fruits, having varying nicotine concentrations are also available.

Other proposals have involved flavorings for use in e-cigarettes. The problem with these devices is that they are not vaporized by a single atomizer, and the flavors overlap each other. Thus, an unaddressed need exists in the industry to address the aforementioned deficiencies and inadequacies. Even though the above cited methods for flavored liquid solutions in e-cigarettes meets some of the needs of the market, an e-cigarette with segregated cartridge for selective disbursement of different flavored liquid solutions is still desired.

SUMMARY OF THE INVENTION

The present invention is directed to an e-cigarette that provides multi-flavored, simulated smoking enjoyment. The e-cigarette enables selective disbursement of a plurality of liquid solutions having different flavors for vaporization and simulated smoking. A cartridge segregates a plurality of liquid solutions having unique flavors into distinct compartments. A rotatable barrier is used to segregate the liquid solutions in the cartridge. The cartridge includes a plurality of cartridge openings that enable passage of the liquid solutions from their respective compartments to an atomizing chamber containing an atomizer. The atomizing chamber comprises a plurality of chamber openings that align with the cartridge openings.

The e-cigarette enables selectivity of the desired liquid solution through use of a rotatable plate that is incrementally rotated with the rotation barrier. The rotatable plate includes at least one plate plug and at least one plate opening. The plate plug and the plate opening selectively block or enables passage of the liquid solutions between the cartridge and the atomizing chamber. In this manner, the rotatable plate regulates passage of a desired liquid solution to the atomizer. Thus, a user may easily rotate the rotation mechanism to select the desired flavored liquid solution while simultaneously enjoying simulated smoking.

In one embodiment, the e-cigarette comprises a cartridge defined by an inhalation end, a base end, and a cartridge cavity. The cartridge is segregated into a plurality of compartments by a rotatable barrier. The rotatable barrier extends along the length of the cartridge, engaging both the inhalation end and the base end. The plurality of compartments contain a plurality of liquid solutions. Each liquid solution has a unique flavor that is extenuated when the liquid solution is vaporized. The rotatable barrier maintains each liquid solution in its respective compartment.

The inhalation end of the cartridge is in communication with a mouthpiece that is configured to enable inhalation of the plurality of liquid solutions in their vaporized form. The base end of the cartridge includes a plurality of cartridge openings that enable passage of the liquid solution. Each compartment has a cartridge opening.

The e-cigarette further comprises an atomizing chamber that is disposed generally concentric to the cartridge cavity. The atomizing chamber is defined by a first end, a second end, and a chamber cavity. The second end comprises a plurality of chamber openings. The plurality of chamber openings are in communication with the plurality of cartridge openings, whereby each compartment is in communication with a cartridge opening and a chamber opening. Because the cartridge is segregated into a plurality of compartments, only one of the plurality of liquid solutions may pass through the chamber opening, and into the cartridge opening at any time.

The chamber cavity is configured to retain an atomizer. The atomizer is configured to vaporize the liquid solution received from the cartridge. It is significant to note that a single atomizer is used for vaporizing all of the liquid solutions. After the selected liquid solution is vaporized by the atomizer, a vapor channel carries the vaporized liquid solution from the atomizing chamber to the mouthpiece. A battery is configured to heat the atomizer, so as to achieve sufficient heat to vaporize the liquid solutions.

A rotatable plate is disposed between the cartridge opening and the chamber opening, generally coplanar to the base end of the cartridge. The rotatable plate joins with the rotatable barrier. The rotatable plate includes a plate opening and a plate plug. Though rotatable manipulation of the plate opening and the plate plug, the rotatable plate may be manipulated to selectively block or enables passage of the different flavored liquid solutions between the compartments of the cartridge and the atomizing chamber by either plugging the openings with the plate plug, or enabling passage between the opening with the plate opening.

For example, the plate plug intervenes between the cartridge opening and the chamber opening of a first compartment to restrict passage of a first liquid solution from the first compartment. Simultaneously, the plate opening enables passage of a second liquid solution through the cartridge opening and the chamber opening from a second compartment. In this manner, the rotatable plate regulates passage of the second liquid solution from the second compartment to the atomizer.

A rotation mechanism is operably attached to the inhalation end of the cartridge. The rotation mechanism is configured to simultaneously rotate both the rotatable barrier and the rotatable plate. Thus, a user may easily rotate the rotation mechanism to select the desired flavored liquid solution from a compartment while simultaneously enjoying the simulated smoking.

In operation, the liquid solutions are selectively dispensed into the atomizing chamber by incrementally rotating the rotatable barrier and rotatable plate with the rotation mechanism. By aligning the plate opening with the cartridge opening and the chamber opening, a passage is created for one of the liquid solutions to dispense into the atomizing chamber for vaporization by the atomizer. Accessing a different flavor of liquid solution is possible by rotating the rotation mechanism to move the plate opening to a different compartment, and thereby a different flavor of liquid solution.

In one aspect of the present invention, an e-cigarette with segregated cartridge for selective disbursement of flavored liquid solutions, the e-cigarette comprising:

a cartridge, the cartridge defined by an inhalation end, a base end, and a cartridge cavity, the cartridge cavity segregated into a plurality of compartments by a rotatable barrier, the rotatable barrier disposed to extend along the length of the cartridge, the plurality of compartments containing a plurality of liquid solutions, each liquid solution having a unique flavor, whereby the rotatable barrier segregates each liquid solution in a respective compartment;

a plurality of cartridge openings, the plurality of cartridge openings disposed at the base end of the cartridge, the plurality of cartridge openings configured to enable passage of the plurality of liquid solutions from the plurality of compartments, whereby each compartment has a cartridge opening;

a mouthpiece, the mouthpiece in communication with the inhalation end of the cartridge, the mouthpiece configured to enable inhalation of the plurality of liquid solutions;

an atomizing chamber, the atomizing chamber disposed generally concentric to the cartridge cavity, the atomizing chamber defined by a first end, a second end, and a chamber cavity, the second end comprising a plurality of chamber openings, the plurality of chamber openings configured to be in communication with the plurality of cartridge openings;

an atomizer, the atomizer disposed in the chamber cavity, the atomizer configured to at least partially vaporize the plurality of liquid solutions from the cartridge;

a vapor channel, the vapor channel configured to carry the vaporized liquid solution from the atomizing chamber to the mouthpiece;

a rotatable plate, the rotatable plate disposed between the plurality of cartridge openings and the plurality of chamber openings, the rotatable plate further disposed generally coplanar to the base end of the cartridge, the rotatable plate configured to join with the rotatable barrier, the rotatable plate comprising at least one plate opening and at least one plate plug, the rotatable plate further configured to selectively block or enable passage of the plurality of liquid solutions to the atomizing chamber by intervening the at least one plate plug or the at least one plate opening between the plurality of cartridge openings and the plurality of chamber openings; and a rotation mechanism, the rotation mechanism configured to operably attach to the inhalation end of the cartridge for rotating the rotatable barrier and the rotatable plate.

One objective of the present invention is to provide multiple flavors of liquid solution in one e-cigarette.

Another objective is to enable interchangeability of the flavors of liquid solutions.

Another objective is to provide an e-cigarette that can interchangeably vaporize nicotine e-liquid solutions, non-nicotine e-liquid solutions, cannabis oil, and cannabis based solutions.

Another objective is to enable selectivity of the desired flavor through simple rotation of a knob at the inhalation end of the cartridge.

Another objective is to vaporize the plurality of liquid solutions with a single atomizer.

Another objective is to provide an interchangeable cartridge containing the plurality of liquid solutions.

Yet another objective is to replace the atomizer with a cartomizer that houses a heating element for vaporizing the e-liquid solutions.

Yet another objective is to provide an inexpensive to manufacture an e-cigarette that enables simulated smoking of a plurality of flavored liquid solutions.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 1 illustrates a perspective view of an exemplary e-cigarette with segregated cartridge for selective disbursement of flavored liquid solutions, in accordance with an embodiment of the present invention.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing FIGURES, as may be further described or explained by the entire written specification of which this detailed description is an integral part. The drawings are intended to be read together with the specification and are to be construed as a portion of the entire "written description" of this invention as required by 35 U.S.C. §112.

In one embodiment of the present invention referenced in FIG. 1, an e-cigarette 100 provides segregated cartridges that contain a plurality of flavored liquid solutions. Each liquid solution has a unique flavor, and is individually selected from its respective compartment for simulated smoking enjoyment.

The e-cigarette 100 enables selective disbursement of the flavored liquid solutions for vaporization and inhalation. The liquid solutions are vaporized in an atomizing chamber 108 through a single atomizer 112. Thus, through the segregated retention of liquid solutions, the e-cigarette 100 uses only one atomizer 112 to vaporize all of the liquid solutions; thereby minimizing the undesirable intermingling of flavors between liquid solutions.

As referenced in FIG. 1, the e-cigarette 100 is generally elongated and cylindrical, so as to simulate a real cigarette known in the art. Though, any number of shapes may be used. In one embodiment, the e-cigarette 100 is configured to operate with a nicotine delivery system, or a cannabinoid delivery system. In one possible embodiment, the e-cigarette 100 is a plastic stick that uses a nicotine filter cartridge to simulate the traditional smoking experience while dispensing controlled amounts of nicotine that are flavored. Unlike the traditional smoking experience, however, the e-cigarette 100 does not contain smoke or tar.

In one embodiment, the e-cigarette 100 comprises a cartridge 102 that is defined by an inhalation end 128, a base end 130, and a cartridge cavity. The cartridge cavity is segregated into a plurality of compartments 104*a-b* by a rotatable barrier 118. The rotatable barrier 118 extends along the length of the cartridge 102, engaging both the inhalation end 128 and the base end 130. In one embodiment, the rotatable barrier 118 is a flat panel that segregates the cartridge 102 cavity into two separate compartments 104*a-b*. Though in other embodiments, the rotatable barrier 118 may have additional panels that segregate the cartridge cavity into three or more compartments 104*a-b*.

The plurality of compartments 104*a-b* contain a plurality of liquid solutions. Each liquid solution has a unique flavor that is extenuated when the liquid solution is vaporized. The rotatable barrier 118 extends along the length of the cartridge 102, sealing the base end 130 and the inhalation end 128, such that each liquid solution is fully segregated in its respective compartment 104*a-b*. In this manner, undesirable mixture of flavors is inhibited.

The liquid solutions may include, without limitation, a nicotine e-liquid, a non-nicotine e-liquid, and cannabis oil. In one embodiment, the composition of the liquid solution comprises at least one ingredient of the following: propylene glycol, vegetable glycerin, nicotine, water, flavorings, and mixtures thereof. The flavors of the liquid solutions may include, without limitation, fruit, flowers, desserts, tobacco, vanilla, bubble gum, mint menthol, coffee, licorice, fresh mountain air, and combinations thereof. In any case, myriad flavors for the liquid solutions can be selectively vaporized for simulated smoking enjoyment through the e-cigarette 100.

The inhalation end 128 of the cartridge 102 is in communication with a mouthpiece 116. The mouthpiece 116 is configured to enable inhalation of the plurality of liquid solutions in their vaporized form. The mouthpiece 116 extends from the inhalation end 128 and is shaped and dimensioned to by operable by a mouth for sucking, inhaling, and tasting the flavors of the vaporized liquid solutions.

The base end 130 of the cartridge 102 includes a plurality of cartridge openings 106 that is configured to enable passage of the liquid solution. The cartridge openings 106 may include a slit, a hole, and a filtered aperture. The sucking force from the user or gravitational force may be used to force the liquid solution through the cartridge opening 106. In any case, the liquid solution can easily pass through the cartridge opening 106.

The cartridge 102 can be used independently by itself, or interchanged to operate with personal vaporizers, or utilized in a single/multi use e-cigarette design, or a customizable component for a personal vaporizer, clearomizer, or cartomizer.

The e-cigarette 100 further comprises an atomizing chamber 108 that is disposed generally concentric to the cartridge 102. The atomizing chamber 108 is defined by a first end 132, a second end 134, and a chamber cavity. The second end 134 of the atomizing chamber 108 comprises a plurality of chamber openings 110. The plurality of chamber openings 110 are in communication with the plurality of cartridge openings 106. In this manner, each compartment 104*a-b* is in communication with a respective cartridge opening 106 and chamber opening 110.

In one possible embodiment, the cartridge openings 106 align with the chamber openings 110. However, because the cartridge 102 is segregated into a plurality of compartments 104*a-b*, only one of the plurality of liquid solutions may pass through the chamber opening 110, and into the cartridge opening 106 at any time. In some embodiments, each compartment 104*a-b* maintains communication with one distinct chamber opening 110 and one distinct cartridge opening 106.

The chamber cavity is configured to retain an atomizer 112. The atomizer 112 is configured to vaporize the liquid solution that is received from the cartridge 102. It is significant to note that a single atomizer 112 is used for vaporizing all of the liquid solutions. The atomizer 112 may include a battery that heats the atomizer 112 to a desired temperature efficacious for optimizing the vaporization of the liquid solutions. The battery may include an electrode and a cathode that are configured to heat the atomizer 112, so as to achieve sufficient heat to vaporize the liquid solutions. In one embodiment, the atomizer 112 combines and heats the liquid solutions with air to form a uniform, full bodied mist.

In some embodiments, the amount and speed of airflow permitted into the atomizer 112 may be adjustable through at least one air inlet hole. An adjustment ring near the mouthpiece 116 regulates the air inlet hole by rotatably increasing the air flow when rotated in a first direction, and decreasing the air flow through the air inlet hole when rotated in a second direction. After the selected liquid solution is vaporized by the atomizer 112, a vapor channel 114 carries the vaporized liquid solution from the atomizing chamber 108 to the mouthpiece 116. The vapor channel 114 may include an elongated tube that carries the vaporized liquid solution to the mouthpiece 116.

In one alternative embodiment, a cartomizer may be used for vaporizing the liquid solutions. The cartomizer generates an aerosol mist that is a replacement for cigarette smoke. In particular, the cartomizer may use heat, ultrasonic energy, or other means to vaporize the liquid solutions. In one embodiment, the cartomizer includes a heating element to vaporize the liquid solutions.

Looking back at FIG. 1, the e-cigarette 100 utilizes a rotatable plate 120 that is disposed between the cartridge opening 106 and the chamber opening 110. The rotatable plate 120 is generally coplanar to the base end 130 of the cartridge 102. The rotatable plate 120 joins with the rotatable barrier 118 at a perpendicular orientation, such that engagement with the sidewalls of the cartridge 102 are sealed by the rotatable barrier 118 and the rotatable plate 120. The rotatable plate 120 has a diameter that enables a snug fit inside the cartridge 102.

The rotatable plate 120 includes at least one plate opening 124 and at least one plate plug 122. Though rotatable manipulation of the plate opening 124 and the plate plug 122, the rotatable plate 120 may be manipulated to selectively block or enables passage of the different flavored liquid solutions between the compartments 104*a-b* of the cartridge 102 and the atomizing chamber 108 by either plugging the openings 106, 110 with the plate plug 122, or enabling passage between the openings 106, 110 and the plate opening 124.

For example, the plate plug 122 intervenes between the cartridge opening 106 and the chamber opening 110 of a first compartment 104*a* to restrict passage of a first liquid solution from the first compartment 104*a*. Simultaneously, the plate opening 124 enables passage of a second liquid solution through the cartridge opening 106 and the chamber opening 110 from a second compartment 104*b*. In this manner, the rotatable plate 120 regulates passage of the second liquid solution from the second compartment 104*b* to the atomizer 112. Thus, a user may easily rotate the rotation mechanism 126 to select the desired flavored liquid solution while in the process of enjoying simulated smoking.

A rotation mechanism 126 is operably attached to the inhalation end 128 of the cartridge 102. The rotation mechanism 126 is configured to simultaneously rotate both the rotatable barrier 118 and the rotatable plate 120. In one embodiment, the rotation mechanism 126 is a knob that encircles the circumference of the inhalation end 128 of the cartridge 102 while attached to the rotatable barrier 118. Though other mechanisms known in the art that enable rotation of the rotatable barrier 118 and the rotatable plate 120 are possible.

In operation, the e-cigarette 100 provides simulated smoking in much the same manner as other e-cigarettes known in the art. However, the selection of flavors from the liquid solutions, and the vaporizing of all the liquid solutions through a single atomizer 112 create a unique smoking experience. In one possible embodiment, the liquid solutions are selectively dispensed into the atomizing chamber 108 by incrementally rotating the rotatable barrier 118 and rotatable plate 120 with the rotation mechanism 126.

Thus, by aligning the plate opening 124 with the cartridge opening 106 and the chamber opening 110, a passage is created for one of the liquid solutions from a compartment 104*a* to dispense into the atomizing chamber 108. Accessing a different flavor of liquid solution is possible by rotating the rotation mechanism 126 to move the plate opening 124 to a different compartment 104*b*, and thereby a different flavor of liquid solution. In this manner, selectivity of a plurality of flavored liquid solutions are vaporized through a single atomizer 112 so as to enable simulated smoking with the e-cigarette 100.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. An e-cigarette with segregated cartridge for selective disbursement of flavored liquid solutions, the e-cigarette comprising:

a cartridge, the cartridge defined by an inhalation end, a base end, and a cartridge cavity, the cartridge cavity segregated into a plurality of compartments by a rotatable barrier, the rotatable barrier disposed to extend along the length of the cartridge, the plurality of compartments containing a plurality of liquid solutions, each liquid solution having a unique flavor, whereby the rotatable barrier segregates each liquid solution in a respective compartment;

a plurality of cartridge openings, the plurality of cartridge openings disposed at the base end of the cartridge, the plurality of cartridge openings configured to enable passage of the plurality of liquid solutions from the plurality of compartments, whereby each compartment has a cartridge opening;

a mouthpiece, the mouthpiece in communication with the inhalation end of the cartridge, the mouthpiece configured to enable inhalation of the plurality of liquid solutions;

an atomizing chamber, the atomizing chamber disposed generally concentric to the cartridge cavity, the atomizing chamber defined by a first end, a second end, and a chamber cavity, the second end comprising a plurality of chamber openings, the plurality of chamber openings configured to be in communication with the plurality of cartridge openings;

an atomizer, the atomizer disposed in the chamber cavity, the atomizer configured to at least partially vaporize the plurality of liquid solutions from the cartridge;

a vapor channel, the vapor channel configured to carry the vaporized liquid solution from the atomizing chamber to the mouthpiece;

a rotatable plate, the rotatable plate disposed between the plurality of cartridge openings and the plurality of chamber openings, the rotatable plate further disposed generally coplanar to the base end of the cartridge, the rotatable plate configured to join with the rotatable barrier, the rotatable plate comprising at least one plate opening and at least one plate plug, the rotatable plate further configured to selectively block or enable passage of the plurality of liquid solutions to the atomizing chamber by intervening the at least one plate plug or the at least one plate opening between the plurality of cartridge openings and the plurality of chamber openings; and a rotation mechanism, the rotation mechanism configured to operably attach to the inhalation end of the cartridge for rotating the rotatable barrier and the rotatable plate.

2. The e-cigarette of claim 1, wherein the e-cigarette is configured to operate with a nicotine delivery system.

3. The e-cigarette of claim 1, wherein the plurality of liquid solutions includes at least one member selected from the group consisting of: a nicotine e-liquid, a non-nicotine e-liquid, and cannabis oil.

4. The e-cigarette of claim 1, wherein ingredients for the plurality of liquid solutions includes at least one member selected from the group consisting of: propylene glycol, vegetable glycerin, nicotine, water, flavorings, and mixtures thereof.

5. The e-cigarette of claim 1, wherein flavors for the plurality of liquid solutions includes at least one member selected from the group consisting of: fruit, flowers, desserts, tobacco, vanilla, bubble gum, mint, coffee, licorice, fresh mountain air, and combinations thereof.

6. The e-cigarette of claim 1, wherein the plurality of compartments comprises two compartments, each compartment in communication with one cartridge opening and one chamber opening.

7. The e-cigarette of claim 1, wherein the rotatable barrier comprises a flat panel.

8. The e-cigarette of claim 1, wherein the plurality of cartridge openings comprises filtered holes.

9. The e-cigarette of claim 1, wherein the plurality of chamber openings comprises filtered holes.

10. The e-cigarette of claim 1, wherein the mouthpiece further includes a nozzle disposed to position sequentially to the inhalation end of the cartridge.

11. The e-cigarette of claim 1, wherein the rotatable plate is circular in shape.

12. The e-cigarette of claim 1, wherein the vapor channel is configured to be nonporous.

13. The e-cigarette of claim 1, further including a cartomizer.

14. The e-cigarette of claim 13, wherein the cartomizer comprises a heating element.

15. The e-cigarette of claim 1, wherein the rotation mechanism is a knob.

16. An e-cigarette with segregated cartridge for selective disbursement of flavored liquid solutions, the e-cigarette comprising:

a cartridge, the cartridge defined by an inhalation end, a base end, and a cartridge cavity, the cartridge cavity segregated into a plurality of compartments by a rotatable barrier, the rotatable barrier disposed to extend along the length of the cartridge, the plurality of compartments containing a plurality of liquid solutions, each liquid solution having a unique flavor, whereby the rotatable barrier segregates each liquid solution in a respective compartment;

a plurality of cartridge openings, the plurality of cartridge openings disposed at the base end of the cartridge, the plurality of cartridge openings configured to enable passage of the plurality of liquid solutions from the plurality of compartments, whereby each compartment has a cartridge opening;

a mouthpiece, the mouthpiece in communication with the inhalation end of the cartridge, the mouthpiece configured to enable inhalation of the plurality of liquid solutions;

an atomizing chamber, the atomizing chamber disposed generally concentric to the cartridge cavity, the atomizing chamber defined by a first end, a second end, and a chamber cavity, the second end comprising a plurality of chamber openings, the plurality of chamber openings configured to be in communication with the plurality of cartridge openings;

an atomizer, the atomizer disposed in the chamber cavity, the atomizer configured to at least partially vaporize the plurality of liquid solutions from the cartridge;

a cartomizer, the cartomizer comprising a heating element, the cartomizer configured to at least partially vaporize the plurality of liquid solutions from the cartridge;

a vapor channel, the vapor channel configured to carry the vaporized liquid solution from the atomizing chamber to the mouthpiece;

a rotatable plate, the rotatable plate disposed between the plurality of cartridge openings and the plurality of chamber openings, the rotatable plate further disposed generally coplanar to the base end of the cartridge, the rotatable plate configured to join with the rotatable barrier, the rotatable plate comprising at least one plate opening and at least one plate plug, the rotatable plate further configured to selectively block or enable passage of the plurality of liquid solutions to the atomizing chamber by intervening the at least one plate plug or the at least one plate opening between the plurality of cartridge openings and the plurality of chamber openings; and a rotation mechanism, the rotation mechanism configured to operably attach to the inhalation end of the cartridge for rotating the rotatable barrier and the rotatable plate.

17. The e-cigarette of claim 16, wherein the e-cigarette is configured to operate with a nicotine delivery system.

18. The e-cigarette of claim 16, wherein the plurality of compartments comprises two compartments, each compartment in communication with one cartridge opening and one chamber opening.

19. An e-cigarette for enabling selective disbursement of flavored liquid solutions, the e-cigarette comprising:

a cartridge, the cartridge defined by an inhalation end, a base end, and a cartridge cavity, the cartridge cavity segregated into a plurality of compartments by a rotatable barrier, the rotatable barrier disposed to extend along the length of the cartridge, the plurality of compartments containing a plurality of liquid solutions, each liquid solution having a unique flavor, whereby the rotatable barrier segregates each liquid solution in a respective compartment; and a plurality of cartridge openings, the plurality of cartridge openings disposed at the base end of the cartridge, the plurality of cartridge openings configured to enable passage of the plurality of liquid solutions from the plurality of compartments, whereby each compartment has a cartridge opening.

20. The cartridge of claim 19, wherein the cartridge is operable with at least one of the following: a cartomizer, a clearomizer, an atomizer, and an e-cigarette.

* * * * *